US007760102B2

(12) United States Patent
Chabanis et al.

(10) Patent No.: US 7,760,102 B2
(45) Date of Patent: Jul. 20, 2010

(54) FIRE OR SMOKE DETECTOR WITH HIGH FALSE ALARM REJECTION PERFORMANCE

(75) Inventors: Gilles Chabanis, Versailles (FR); Philippe Mangon, Elancourt (FR); Stephane Rivet, Blagnac (FR)

(73) Assignee: Siemens AG, Zurich (CH)

( * ) Notice: Subject to any disclaimer, the term of this patent is extended or adjusted under 35 U.S.C. 154(b) by 281 days.

(21) Appl. No.: 11/921,433

(22) PCT Filed: May 23, 2006

(86) PCT No.: PCT/EP2006/004866

§ 371 (c)(1),
(2), (4) Date: Nov. 29, 2007

(87) PCT Pub. No.: WO2006/131204

PCT Pub. Date: Dec. 14, 2006

(65) Prior Publication Data

US 2009/0051552 A1 Feb. 26, 2009

(30) Foreign Application Priority Data

Jun. 10, 2005 (EP) ..... 05291262

(51) Int. Cl.
*G08B 17/00* (2006.01)

(52) U.S. Cl. ..... 340/584; 340/588; 340/628; 340/630

(58) Field of Classification Search ..... 340/584, 340/587–589, 577–579, 628–630
See application file for complete search history.

(56) References Cited

U.S. PATENT DOCUMENTS 4,642,471 A 2/1987 Guettinger et al.

(Continued)

FOREIGN PATENT DOCUMENTS

EP 0 418 409 A1 3/1991

(Continued)

OTHER PUBLICATIONS

Strategies for the development of detection algorithms; AUBE '01, 12th International Conference on Automatic Fire Detection, Gaithersburg, MD, USA; Mar. 25, 2001; pp. 163-175; XP002354981.

(Continued)

*Primary Examiner*—John A Tweel, Jr.
(74) *Attorney, Agent, or Firm*—Laurence A. Greenberg; Werner H. Stemer; Ralph E. Locher

(57) ABSTRACT

An apparatus for detecting a hazardous condition includes an optical module for measuring scattered light caused by the hazardous condition, a temperature sensor, a humidity sensor, and a processing unit coupled to receive signals from the optical module, the temperature sensor and the humidity sensor. The processing unit processes the signals to determine criteria to distinguish deceptive phenomena from a hazardous condition in order to limit false alarms. The processing unit uses the criteria for adjusting an alarm threshold value that is a function of a reference function, a function based on temperature criteria, a function based on at least one of the temperature criteria and a ratio criterion, and a function based on humidity criteria.

9 Claims, 6 Drawing Sheets

U.S. PATENT DOCUMENTS

| | | | | |
|---|---|---|---|---|
| 5,281,951 | A * | 1/1994 | Okayama | 340/588 |
| 5,523,744 | A | 6/1996 | Wieser | |
| 6,392,536 | B1 | 5/2002 | Tice et al. | |
| 6,897,774 | B2 * | 5/2005 | Costa et al. | 340/628 |
| 6,967,582 | B2 * | 11/2005 | Tice et al. | 340/630 |
| 7,030,766 | B2 * | 4/2006 | Right et al. | 340/584 |
| 7,034,701 | B1 * | 4/2006 | Rose-Pehrsson et al. | 340/628 |
| 7,075,445 | B2 * | 7/2006 | Booth et al. | 340/630 |
| 2003/0020617 | A1 | 1/2003 | Tice et al. | |
| 2006/0007009 | A1 | 1/2006 | Hess et al. | |
| 2008/0061996 | A1 * | 3/2008 | Behle et al. | 340/628 |
| 2008/0173817 | A1 * | 7/2008 | Goldstein et al. | 340/584 |

FOREIGN PATENT DOCUMENTS

| | | | |
|---|---|---|---|
| EP | 0 418 410 | A1 | 3/1991 |
| EP | 0 418 411 | A1 | 3/1991 |
| EP | 0 729 123 | A1 | 8/1996 |
| EP | 0 821 330 | A1 | 1/1998 |
| EP | 0 926 646 | A1 | 6/1999 |
| EP | 1 087 352 | A1 | 3/2001 |
| WO | WO 84/01950 | | 5/1984 |

OTHER PUBLICATIONS

Derwent Abstract—EP 0 418 411 A1; Mar. 27, 1991; Siemens Aktiengesellschaft, D-8000 Muenchen, Germany.

Derwent Abstract—EP 0 418 409 A1; Mar. 27, 1991; Siemens Aktiengesellschaft, D-8000 Muenchen, Germany.

Derwent Abstract—EP 0 418 410 A1; Mar. 27, 1991; Siemens Aktiengesellschaft, D-8000 Muenchen, Germany.

Derwent Abstract—EP 0 926 646 A1; Jun. 30, 1999; Siemens Building Technologies AG, CH-8708 Maennedorf, Switzerland.

Derwent Abstract—EP 0 821 330 A1; Jan. 28, 1998; Cerberus AG, CH-8708 Maennedorf, Switzerland.

Derwent Abstract—EP 1 087 352 A1; Mar. 28, 2001; Siemens Building Technologies AG, CH-8034 Zuerich, Switzerland.

* cited by examiner

Variance evaluation
30
σ
S1
Bottom Line Extraction
32
B
S2
LPF
34
BW/FW
36
R
S3
Bottom Line Extraction
38
LPF
40
BW
R1
FW
R2
$T_{opt}$
R7
$T_1$
R3
$T_2$
R4
Max ($T_1$, $T_2$)
42
LPF
44
$T_0$, Long term average
48
Derivative
46
dT
T1
T
T2
Variation $\Delta T = T - T_0$
50
ΔT
T3
LPF
52

FIRE OR SMOKE DETECTOR WITH HIGH FALSE ALARM REJECTION PERFORMANCE

CROSS-REFERENCE TO RELATED APPLICATIONS

The present application is a national phase application of PCT/EP2006/004866, filed on May 23, 2006, which claims priority to European Patent Application No. 05 291 262.3, filed on Jun. 10, 2005, both of which are hereby incorporated by reference.

BACKGROUND OF THE INVENTION

The various embodiments described herein generally relate to detecting a hazardous condition within a structure. More particularly, the various embodiments relate to a detector and a method for detecting a hazardous condition using multiple criteria for improved reliability.

One example of a detector for detection of a hazardous condition is a fire detector. For example, EP 1376505 describes an exemplary fire detector that uses multiple criteria for improved reliability. The described fire detector includes a sensor arrangement, an electronic evaluation system and a housing which surrounds the sensor arrangement. Openings provide access for air and, when applicable, smoke to the sensor arrangement. The fire detector accommodates detection modules having sensors for different fire parameters, for example, an electro-optical sensor for detecting scattered light generated by smoke present in the ambient air, or one or more temperature sensors for detecting heat generated by a fire, or a gas sensor for detecting combustion gases, or combinations of these sensors.

EP 729123 describes a multiple sensor detection system. A fire detector detects a hazardous condition, such as fire, gas, or overheat, and an environmental condition detector detects another condition, such as humidity, ambient pollution level, presence or absence of sunlight. The two detectors are coupled to circuitry so that the output from the fire detector triggers an alarm condition only in the absence of an output from the environmental condition detector. That is, in the presence of a selected environmental condition (e.g., humidity or pollution), any output from the fire detector indicative of gas, fire, temperature or the like is inhibited at least for a predetermined period of time. In the absence of an output from the environmental condition detector, the fire detector produces a signal indicative of the sensed gas, temperature or fire condition.

The fire detector and detection system described above strive to minimize false alarms. However, false alarms of systems that detect and warn of hazardous conditions, such as a fire, remain a major issue in various applications and particularly those where extreme environmental conditions can lead to the formation of deceptive phenomena such as dust suspended in the air, fog, condensation or water steam. These extreme conditions may occur in transportation applications such as in aircrafts, trains, seagoing vessels, or military vehicles, satellites, building applications such as in kitchens, machine rooms or hotel rooms, or on industrial sites. The relatively high rate of false alarms arising under these extreme conditions using current detection technologies has a significant cost impact. Further, false alarms are a severe safety concern because people lose more and more confidence in fire detection systems.

SUMMARY OF CERTAIN INVENTIVE ASPECTS

Therefore, it is an objective to improve a detector to further minimize the risk of false alarms, in particular under extreme conditions, as described above.

Accordingly, one aspect involves an apparatus for detecting a hazardous condition including fire, smoke or both. The apparatus includes an optical module for measuring scattered light caused by the hazardous condition, wherein the optical module is configured to output at least one signal indicative of the scattered light, at least one temperature sensor configured to output at least one signal indicative of a temperature in proximity of the temperature sensor, and a humidity sensor configured to output at least one signal indicative of humidity in proximity of the humidity sensor. The apparatus includes further a processing unit coupled to receive the signals from the optical module, the at least one temperature sensor and the humidity sensor, wherein the processing unit is configured to process the signals to determine a plurality of criteria and to use these criteria to distinguish one or more deceptive phenomena from a hazardous condition in order to limit false alarm warnings and to enhance a detection performance.

Another aspect involves a method of detecting a hazardous condition including fire, smoke or both. The method determines a signal indicative of scattered light caused by the hazardous condition, at least one signal indicative of a temperature condition, and at least one signal indicative of a humidity condition. Further, the method processes the signals indicative of scattered light, temperature condition and humidity condition to determine a plurality of criteria, and uses the criteria to distinguish one or more deceptive phenomena from a hazardous condition in order to limit false alarm warnings and to enhance a detection performance.

BRIEF DESCRIPTION OF THE SEVERAL VIEWS OF THE DRAWINGS

These and other aspects, advantages and novel features of the embodiments described herein will become apparent upon reading the following detailed description and upon reference to the accompanying drawings. In the drawings, same elements have the same reference numerals.

DETAILED DESCRIPTION OF CERTAIN INVENTIVE EMBODIMENTS

The certain inventive embodiments described hereinafter generally relate to a detector and a method for detecting a hazardous condition within a structure. The detector may be installed in structures such as automobiles, trains, aircrafts, vessels, kitchens, machine rooms or hotel rooms, or on industrial sites. However, it is contemplated that the detector may be installed at any location where the risk of a hazardous condition exists and rapid intervention is required to protect people or property, or both, from harm. Exemplary hazardous conditions include fire, smoke, gas, overheat and intrusion.

Figure 1:
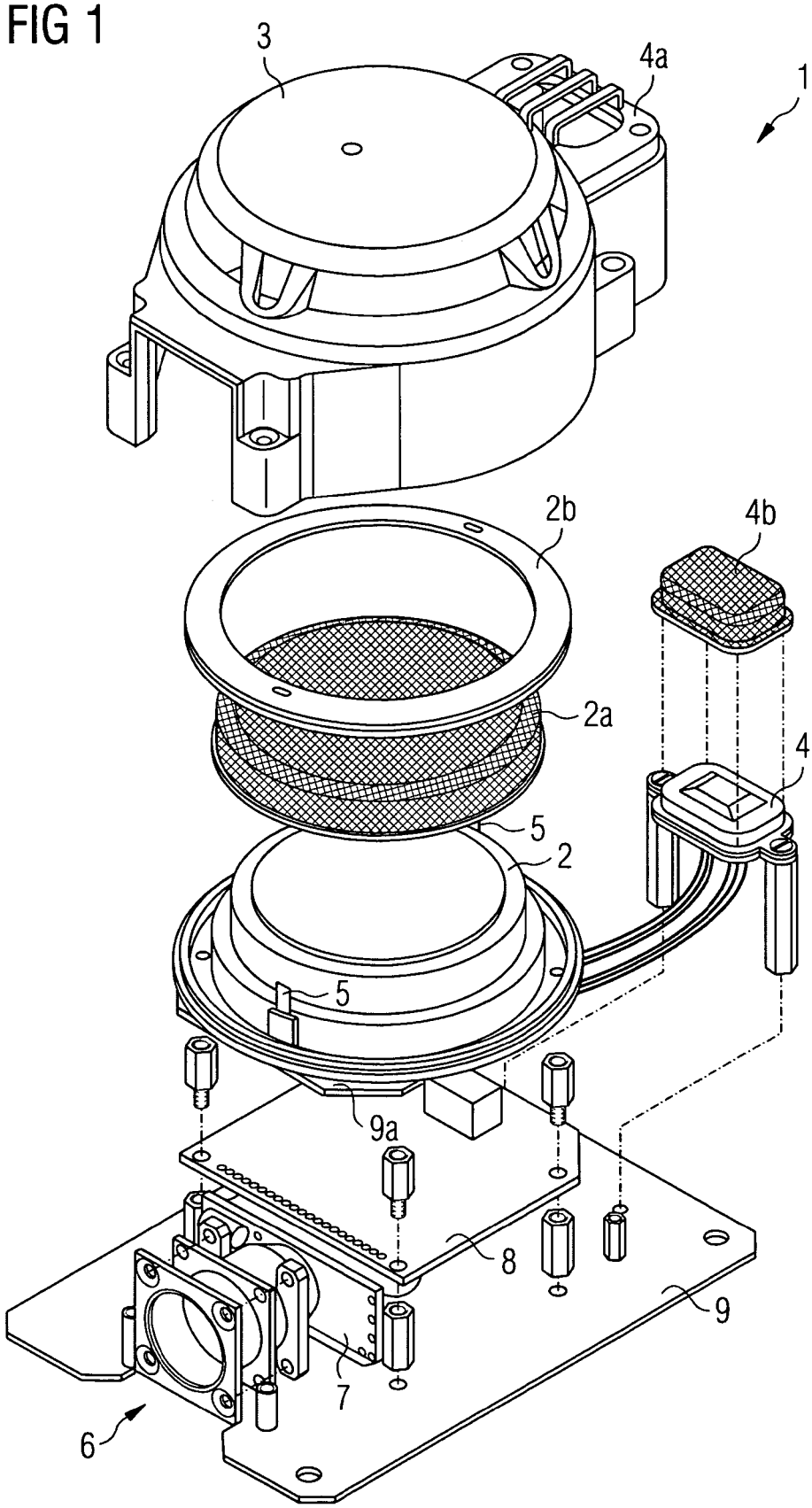
FIG. 1 is a schematic exploded view of a first embodiment of a detector.

FIG. 1 is a schematic exploded view of an exemplary embodiment of a detector 1. In one embodiment, the detector 1 is configured to detect excessive heat, smoke or fire, as exemplary hazardous conditions. The detector 1 includes a housing 3 mounted to a base 9. The base 9 is configured for mounting, for example, to a ceiling of a cargo compartment or a room to be monitored. Further, the detector 1 includes an optical sensor system 2, a humidity detector 4, temperature sensors 5 and a plug connector 6. The plug connector 6, the optical sensor system 2, the temperature sensors 5 and the humidity detector 4 are mounted to the base 9. A grid 2*a* and a grid holder 2*b* are placed between the optical sensor system 2 and a corresponding section of the housing 3. Likewise, a grid 4*b* is placed between the humidity sensor 4 and a corresponding section 4*a* of the housing 3. The grids 2*a*, 4*b* prevent entry of extraneous objects (e.g., insects) into the detector 1.

The optical sensor system 2 includes in the illustrated embodiment a processing unit coupled to receive signals from the temperature sensors 5 and the humidity sensor 4. Printed circuit boards 7, 8, 9*a* couple the processing unit of the optical sensor system 2 to the plug connector 6 to provide for communications between the detector 1 and a remote control station.

Figure 2:
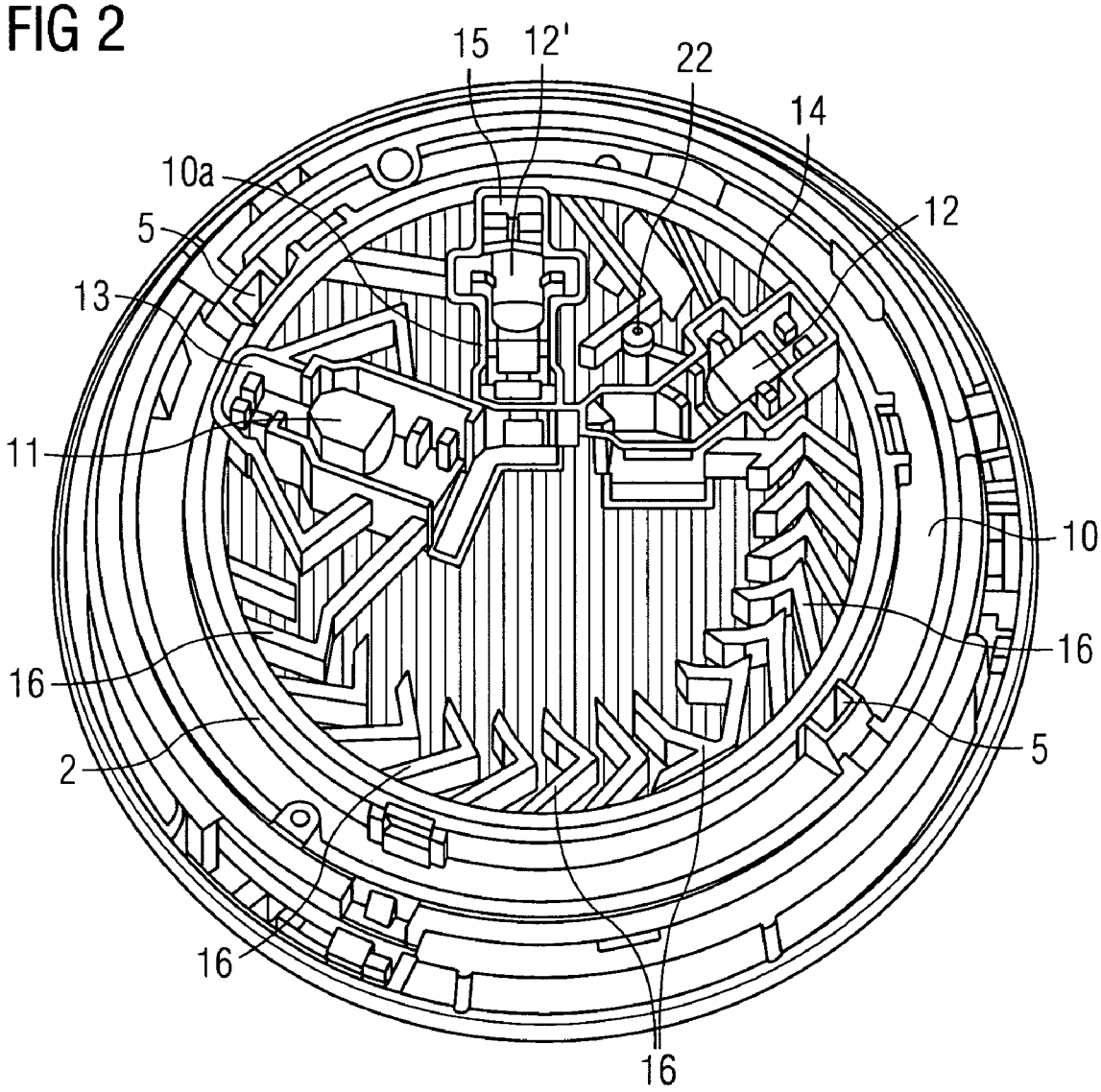
FIG. 2 is a schematic view of a cross-section through an optical sensor system of the detector of FIG. 1.

FIG. 2 is a schematic view of a cross-section through the optical sensor system 2 of the detector 1 of FIG. 1. In one embodiment, the optical sensor system 2 may be similar to the optical sensor system described in EP 1 376 505. Therefore, the optical sensor system 2 is here described only briefly to the extent believed to be helpful for understanding the structure and operation of the detector 1. Additional details are described in EP 1 376 505.

The optical sensor system 2 contains a measuring chamber formed by a carrier 10 and a labyrinth 10*a*, a light detector 11 and two light sources 12, 12' (e.g., optical diodes) arranged in housings 13, 14, 15, respectively. These housings 13, 14, 15 have a base part in which the respective diode (photodiode or emitting diode) is mounted and which has on its front side facing towards a center of the measuring chamber a window opening for the ingress and egress of light. As shown in FIG. 2, a scatter chamber formed in the measuring chamber in the vicinity of the above-mentioned window-like openings in the housings 13, 14, 15 is compact and open.

The frames of the window openings are formed in one piece, at least for the housings 14 and 15, whereby the tolerances for smoke-sensitivity are reduced. In known scattered-light smoke detectors the window frames consist of two parts, one of which is integrated with the cover and the other with the base of the measuring chamber. When fitting the base, difficulties of fit constantly occur, giving rise to variable window sizes and to the formation of a light gap between the two halves of the window, and therefore to unwanted disturbances of the transmitted and detected light. With the one-piece housing windows disturbances of this kind are precluded and no problems with the positioning accuracy of the window halves can arise. The windows are rectangular or square and there is a relatively large distance between the respective window openings and the associated light sources 12, 12' and the lens of the associated light detector 11, whereby a relatively small aperture angle of the light rays concerned is produced. A small aperture angle of the light rays has the advantage that, firstly, almost no light from the light sources 12, 12' impinges on the base and, secondly, the light detector 11 does not "see" the base, so that dust particles deposited on the base cannot generate any unwanted scattered light. A further advantage of the large distance between the respective windows and the light sources 12, 12' and the lens of the light detector 11 is that the optical surfaces penetrated by light are located relatively deeply inside the housings and therefore are well protected from contamination, resulting in constant sensitivity of the optoelectronic elements.

The labyrinth 10*a* consists of a floor and peripherally arranged screens 16 and contains flat covers for the above-mentioned housings 13, 14, 15. The floor and the screens 16 serve to shield the measuring chamber from extraneous light from outside and to suppress so-called background light (cf. EP-A-0 821 330 and EP-A-1 087 352). The peripherally arranged screens 16 consist in each case of two sections forming an L-configuration. Through the shape and arrangement of the screens 16, and in particular through their reciprocal distances, it is ensured that the measuring chamber is sufficiently screened from extraneous light while its operation can nevertheless be tested with an optical test set (EP-B-0 636 266). Moreover, the screens 16 are arranged asymmetrically so that smoke can enter the measuring chamber similarly well from all directions.

The front edge of the screens 16 is oriented towards the measuring chamber and is configured to be as sharp as possible so that only a small amount of light can impinge on such an edge and be reflected. A floor and covering of the measuring chamber, i.e., the opposed faces of the carrier 10 and the labyrinth 10*a*, have a corrugated configuration, and all surfaces in the measuring chamber, in particular the screens 16 and the above-mentioned corrugated surfaces, are glossy and act as black mirrors. This has the advantage that impinging light is not scattered diffusely but is reflected in a directed manner.

The arrangement of the two light sources 12, and 12' is selected such that the optical axis of the light detector 11 includes an obtuse angle with the optical axis of the one light source, light source 12 according to the drawing, and an acute angle with the optical axis of the other light source, light source 12' according to the drawing. The light of light sources 12, 12' is scattered, for example, by smoke which penetrates the measuring chamber and a part of this scattered light impinges on the light detector 11, being said to be forward-scattered in the case of an obtuse angle between the optical axes of light source and light detector and being said to be backscattered in the case of an acute angle between said optical axes.

It is known that the scattered light generated by forward-scattering is significantly greater than that generated by backscattering, the two components of scattered light differing in a characteristic manner for different types of fire. This phenomenon is known, for example, from WO-A-84/01950 (=U.S. Pat. No. 4,642,471), which discloses, among other matters, that the ratio of scatter having a small scattering angle to scatter having a larger scattering angle, which ratio differs for different types of smoke, can be utilised to identify the type of smoke. According to this document, the larger scattering angle may be selected above 90°, so that the forward-scattering and backscattering are evaluated.

For better discrimination between different aerosols, active or passive polarisation filters may be provided in the beam path on the transmitter and/or detector side. The carrier 10 is suitably prepared and grooves (not shown) in which polarisation filters can be fixed are provided in the housings 13, 14 and 15. As a further option, diodes which transmit a radiation in the wavelength range of visible light (cf. EP-A-0 926 646) may be used as light sources 12, 12', or the light sources may transmit radiation of different wavelengths, for example, one light source transmitting red light and the other blue light.

The processing unit of the detector 1 is configured to provide for a multiple-criteria fire or smoke detection algorithm. The algorithm recognizes, for example, the type of smoke based on the evaluation of a relative sensitivity of the forward and backward signals and allows adaptation of the sensitivity. Based on this adjustment of the sensitivity, the sensitivity to deceptive phenomena of, for example, bright aerosol can be reduced. The processing unit receives signals from several sensors of the detector 1 to determine relevant criteria of the fire/nuisance characteristics and to adapt the sensitivity of the detector 1 according to the variation of these criteria, as described hereinafter.

Figures 3, 3A, 3B:
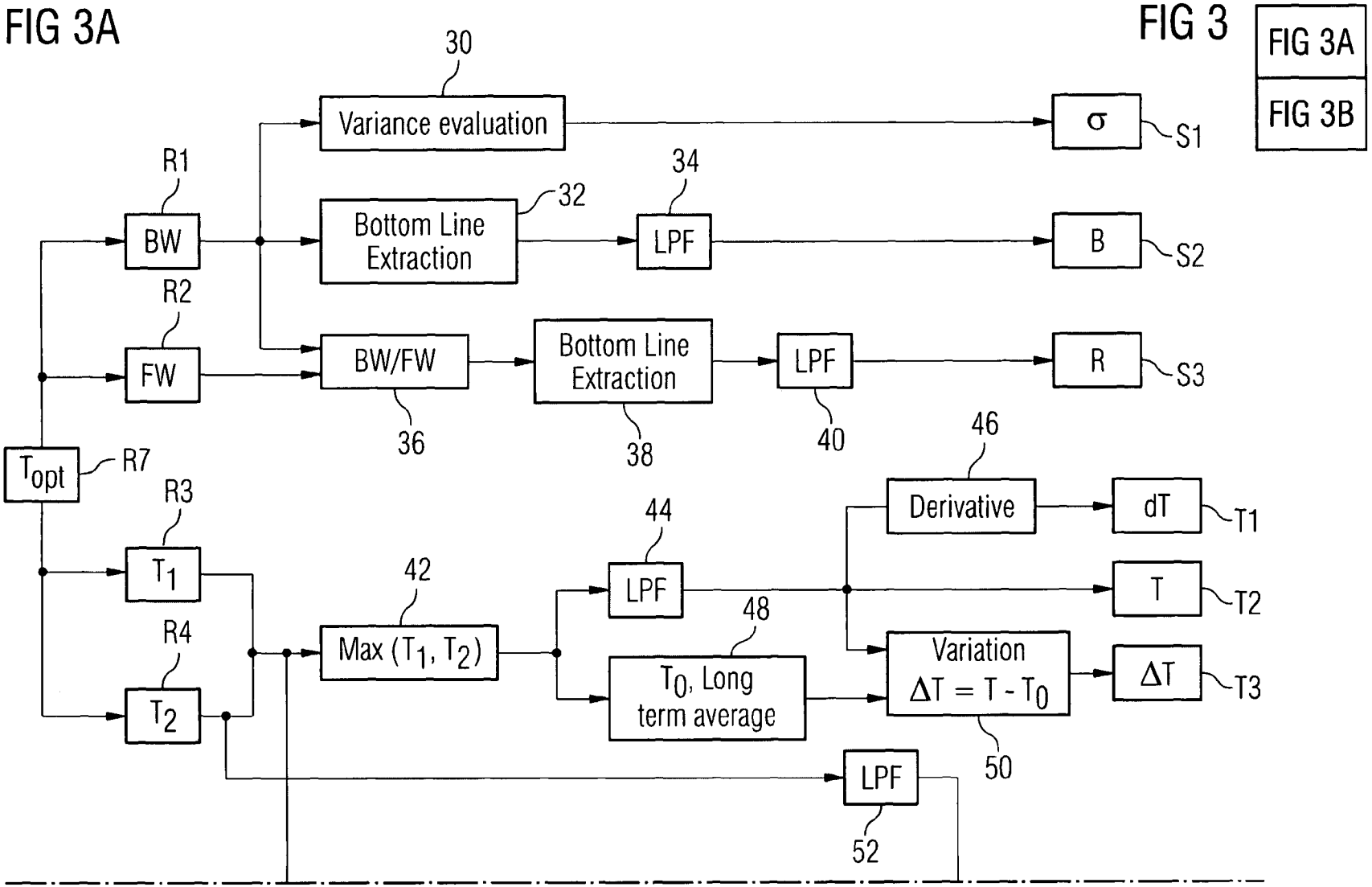
FIGS. 3, 3A and 3B schematically illustrate one embodiment for obtaining selected criteria.
Figure 3B:
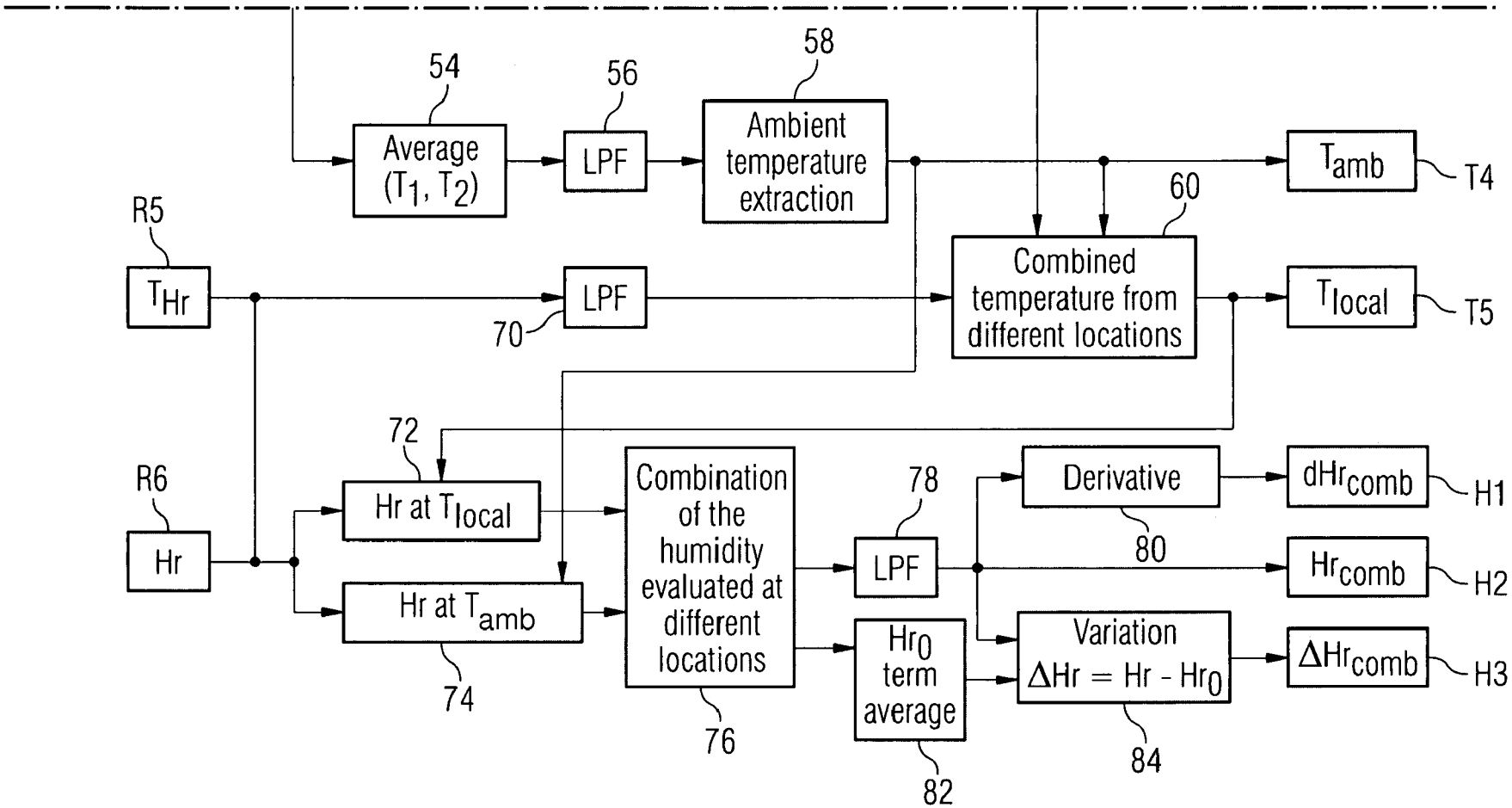

FIG. 3 illustrates schematically one embodiment for obtaining selected criteria. The processing unit is configured to extract these criteria from sensor responses generated within the detector 1, i.e., by the temperature sensors 5, the humidity sensor 4 and the optical module 2 (FIG. 1). In the illustrated embodiment, the sensor responses include a response R1 indicative of a backward scattering signal BW, a response R2 indicative of a forward scattering signal FW, a response R3 indicative of a temperature $T_1$ at a first location, a response R4 indicative of a temperature $T_2$ at a second location, a response R5 indicative of a temperature $T_{Hr}$ at the humidity sensor 4, a response R6 indicative of a humidity Hr, and a response R7 indicative of a temperature $T_{opt}$ in the vicinity of the location of the labyrinth 10*a*.

The processing unit samples the sensor responses with a sampling time that is as short as possible to limit the time delay and that allows the extraction of the relevant information. In one embodiment, the time to sample all input signals may be between about 50 ms and 400 ms, for example, about 200 ms.

In one embodiment, the processing unit obtains several criteria S1, S2, S3 derived from scattered light, e.g., a backward scattering signal B, a variance σ, and a ratio R. A block 30 represents a determination of the variance a of the measurements of the backward scattering signal BW. A block 32 (bottom line extraction) represents an analysis of the measured backward scattering signals BW in order to limit peak amplitudes measured in response to a deceptive phenomena. For example, the analysis detects and uses the minimum (bottom line) signal of each sampled peak, e.g., at the beginning of the peak. A filter 34, for example, a low pass filter, is connected to the block 32 and outputs the backward scattering signal B. A block 36 represents the calculation of a BW/FW ratio of the backward scattering signal BW to the forward scattering signal FW. A block 38 represents an analysis of the BW/FW ratio to limit its peak amplitudes. A filter 40, for example, a low pass filter, filters the BW/FW ration and outputs the ratio R.

Hence, the processing of the backward scattering measurements is based on both the bottom line extraction of the measurements and the filtering of the signal. The concept of the bottom line extraction and filtering includes limiting the sensitivity to particular deceptive phenomena to which the detector 1 is exposed. Indeed, the response of a smoke detector, which is based on evaluating scattered light, to nuisance is generally characterized by a significant dynamic of the scattered light signal compared to the response to a real fire. Therefore, by limiting the peak magnitude obtained in response to certain deceptive phenomena, the sensitivity to false alarms can be decreased without reducing the fire detection performance.

The dynamic of the forward and backward scattering signals evaluated through the variance σ or the standard deviation, and the rate of rise of these signals, are particularly relevant criteria for the discrimination between a real fire and a nuisance as most deceptive phenomena, such as fog/haze, water steam and dust, are characterized by a significant dynamic of the scattering signals.

Another criterion is the ratio R of the backward and the forward scattering signals BW, FW. As indicated above, the evaluation of the ratio R allows recognizing the type of aerosol, and consequently the type of fire or nuisance. For example, smoldering fires are characterized by relatively bright large smoke particles leading to a relatively low value for the ratio R, whereas flaming fires are mainly producing relatively dark small smoke particles leading to a relatively high value for the ratio R.

Further, the processing unit obtains temperature criteria T1, T2, T3, T4, T5, e.g., a maximum temperature T, a long term temperature variation ΔT, a derivative of the temperature dT, an ambient temperature $T_{amb}$, and a local temperature $T_{local}$. A block 42 represents a determination of maximum temperature values (Max($T_1$, $T_2$)) between the two temperature responses $T_1$, $T_2$. A filter 44, for example, a low pass filter, receives and filters the maximum temperature values (Max($T_1$, $T_2$)) and outputs the maximum temperature T. A block 46 represents a determination of a derivative of the maximum temperature values (Max($T_1$, $T_2$)) and outputs the derivative of the temperature dT. A block 48 receives the maximum temperature values (Max($T_1$, $T_2$)) and determines a long term average temperature $T_0$. A block 50 represents a determination of a difference between the maximum temperature T and the temperature $T_0$ and outputs the long term temperature variation ΔT of the maximum response between the two temperature sensors 5.

Further, a block 54 represents a determination of average temperature values (Average($T_1$, $T_2$)) between the two temperature responses $T_1$, $T_2$. A filter 56, for example, a low pass filter, receives and filters the average temperature values. A block 58 receives the output of the filter 56 and extracts the ambient temperature $T_{amb}$. A block 60 represents a determination of a combined temperature from different locations to determine the local temperature $T_{local}$. Accordingly, the block 60 receives as inputs the ambient temperature $T_{amb}$, the temperature $T_2$ filtered through a filter 52, and the temperature $T_{Hr}$ filtered through a filter 70.

Hence, the criterion for the maximum temperature T is based on the selection of the maximum temperature obtained by the two temperature sensors 5 to enhance the temperature response. From the temperature criterion (T), two additional criteria are extracted that reflect the rate the temperature rises over time, i.e., the long term temperature variation ΔT and the short term temperature variation dT. The temperature variation criteria ΔT and dT offer the advantage of being independent of the ambient temperature and are particularly suitable criteria when combined with the forward and backward scattering signals for discriminating between flaming fire and a nuisance characterized by dark aerosol, for example, carbon dust.

The processing unit obtains also humidity criteria H1, H2, H3, e.g., a humidity criterion $Hr_{comb}$, a variation of a long term humidity criterion $\Delta Hr_{comb}$, and a derivative $dHr_{comb}$ of the humidity criterion. A block 72, with inputs for Hr and $T_{local}$, represents a determination of humidity at the local temperature $T_{local}$. A block 74, with inputs for Hr and $T_{amb}$, represents a determination of humidity at the ambient temperature $T_{amb}$, i.e., the humidity of the air surrounding the detector 1. A block 76 represents a combination of humidity values evaluated at different locations and accordingly receives input values from the blocks 72, 74.

A filter 78, for example, a low pass filter, receives and filters input values from block 76 and outputs the humidity criterion $Hr_{comb}$. A block 80 represents a determination of a derivative of the combined humidity of block 76 and outputs the derivative of the humidity criterion $dHr_{comb}$. A block 82 receives the combined humidity values and determines a long term average humidity $Hr_o$. A block 84 represents a determination of a difference between the humidity Hr and the humidity $Hr_o$ and outputs the long term humidity variation $\Delta Hr_{comb}$.

The humidity criterion $Hr_{comb}$ is for discriminating between water related deceptive phenomena and real fire. It combines the relative humidity calculated at different locations of the detector 1 thanks to the measurements of the relative humidity at the humidity sensor location and the temperatures at different temperature sensor locations. From the temperature and relative humidity measurements, the dew point temperature at the humidity sensor location can be calculated allowing a determination of the relative humidity at different locations of the detector 1 thanks to the measurement of the temperature at these locations. From the humidity criterion $Hr_{comb}$ two additional criteria are extracted that reflect the rate of rise of the humidity over the time, i.e., the relatively long term humidity variation $\Delta Hr_{comb}$ and short term humidity variation ($dHr_{comb}$).

The location of the humidity detector 4 is optimized in order to maximize the air flow reaching the detector 4 so as to maximize its response time. Therefore, locating the humidity detector 4 outside the optical chamber 2 is in one embodiment preferred as the temperature measurements at several and selected locations within the detector 1 allow obtaining information about the relative humidity at key locations.

In addition to the foregoing features, the processing unit of the detector 1 provides for a fire detection algorithm that is based on an adjustment of an alarm threshold. One aspect of the adaptive alarm threshold is to modify the alarm threshold according to the values or variations of selected relevant criteria. For example, an alarm signal is in one embodiment triggered when a reference scattering signal, e.g., the backward scattering signal B reaches a set alarm threshold. Thus, the alarm threshold has to increase when the variation of the relevant criterion is characteristic of deceptive phenomena, whereas the alarm threshold has to decrease when the variation of the relevant criterion is characteristic of a fire situation. In one embodiment, the alarm threshold variation is computed for each sampling time.

Figure 4:
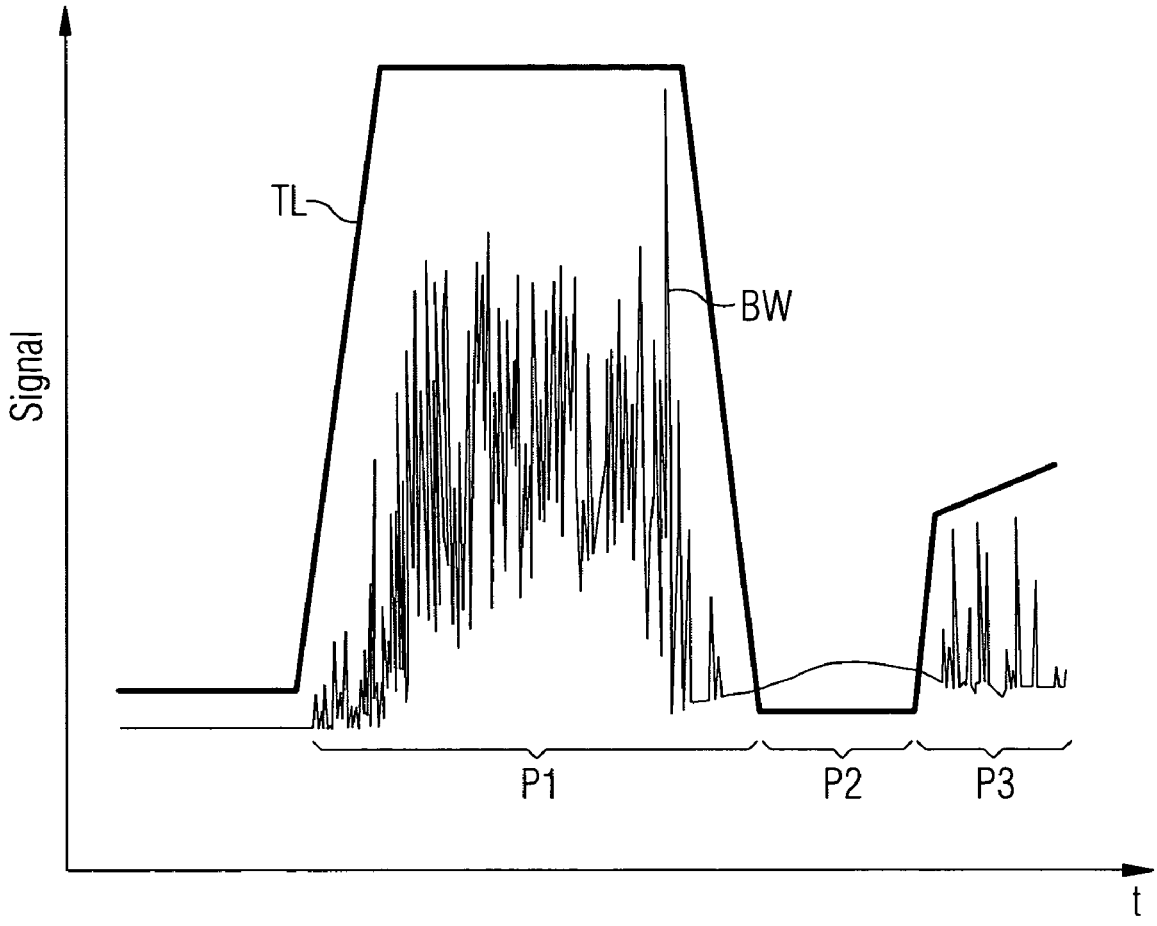
FIG. 4 illustrates schematically one embodiment for adjusting an alarm threshold for various conditions.

FIG. 4 illustrates schematically one embodiment for adjusting an alarm threshold, wherein two graphs TL, BW are illustrated as a function of time. The graph TL represents an exemplary desired alarm threshold level over time, and the graph BW represents the signal amplitude of the backward scattering signal (BW) over time. As shown in FIG. 4, the desired alarm threshold level rises rapidly in the presence of a nuisance, such as water steam. The increased alarm threshold level exists in the embodiment of FIG. 4 during a period P1. The increased alarm threshold level drops in presence of a fire, for example, during a period P2. The alarm threshold level rises again when the fire stops due to the presence of the water steam, for example, during a period P3.

Figure 5:
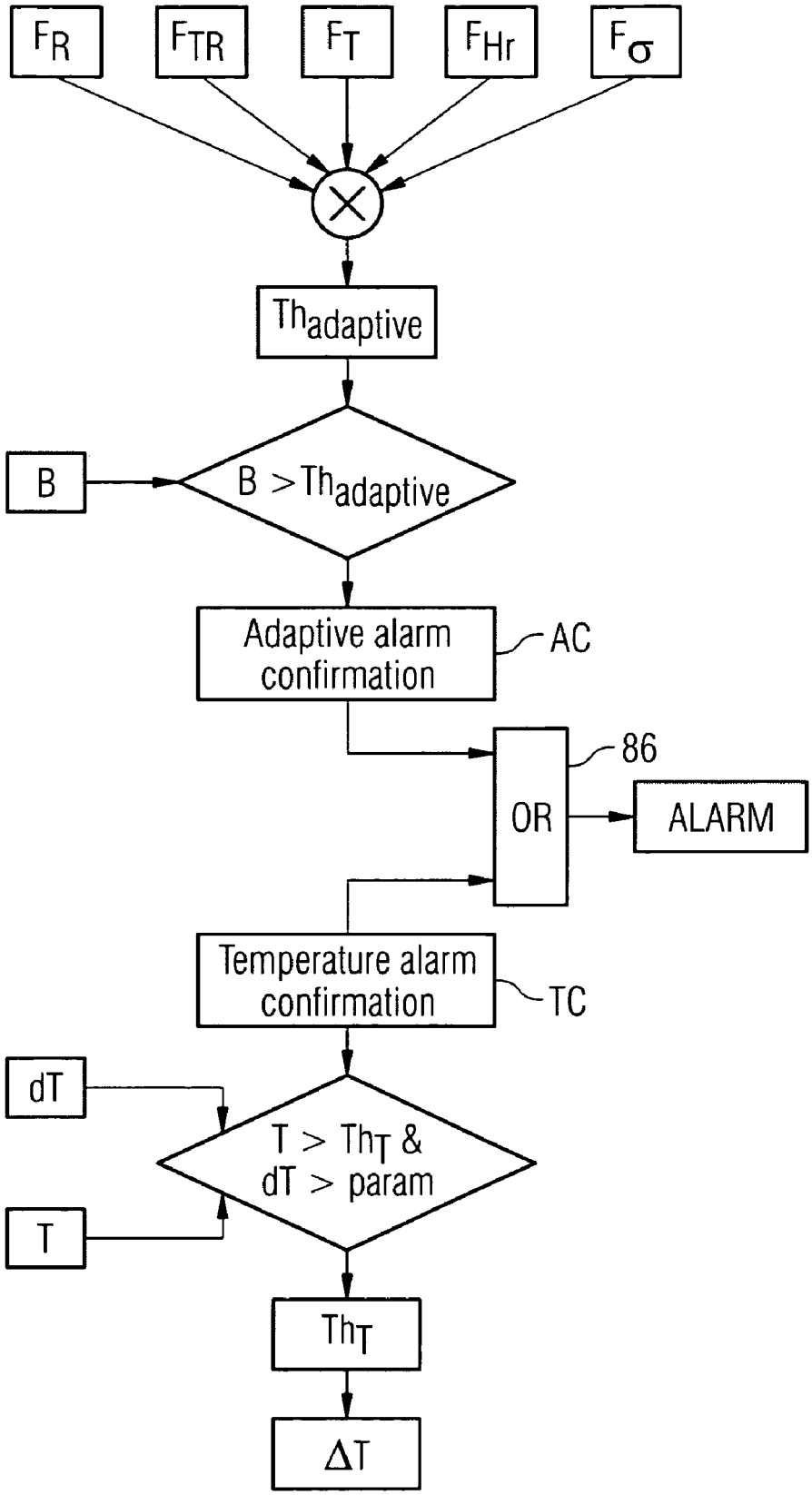
FIG. 5 is a schematic illustration of a fire detection algorithm including an adjustment of an alarm threshold.

In order to achieve the variation of the alarm threshold level shown in FIG. 4, an alarm threshold function is defined that combines in one embodiment the criteria described above. FIG. 5 is a schematic illustration of a fire detection algorithm including an algorithm for adjusting the alarm threshold and a thermal threshold algorithm. As shown in the embodiment of FIG. 5, the alarm threshold function is defined as a function of five main functions $F_R$, $F_T$, $F_{TR}$, $F_{Hr}$ and $F_\sigma$. Each function takes into account one or a combination of the relevant criteria and contributes by its variation to the alarm threshold variation and reflects the discrimination capability of the multiple-criteria fire detector between deceptive phenomena and real fire. The variation and magnitude of variation of each function depend on the discrimination capability between a real fire and a nuisance brought by the combination of the relevant criteria of the different functions.

The selection and the way to combine these criteria are a main aspect and advantage of the various embodiments described herein. The decision resulting from combining these criteria allows discriminating between real fire and deceptive phenomena or nuisances and can be used to adjust an alarm threshold, to compare the variation of the reference signal value depending on the criteria variation to a fixed threshold, to apply the fuzzy logic principle, wherein the combination criteria condition is summarized through a fuzzy rule definition and the decision being taken as a result of the de-fuzzification method.

The function $F_R$ is a reference function and defined to modify the alarm threshold level between two values $MinF_R$ and $MaxF_R$ according to the value of the ratio R. If the ratio R is low, a smoldering fire or a nuisance is characterized by rather bright large particles such as bright dust or water-related nuisances. In that case, the decision is to keep the reference threshold at $MaxF_R$. If the ratio R is high, a flaming fire or a nuisance is characterized by rather dark fine particles such as dark dust or exhaust pipe fume. In that case, the decision is to decrease the reference threshold from $MaxF_R$ to $MinF_R$ to increase the sensitivity.

The function $F_T$ is based on the temperature criteria dT and $\Delta T$ and defined to decrease the reference function $F_R$ depending on the variation of the temperature criteria. If dT or $\Delta T$ are high, an exothermic flaming fire or a rapid variation of the ambient temperature exist. In that case, the decision is to divide the function $F_R$ by a maximum factor of $MaxF_T$ to increase the sensitivity ($F_T$=$MaxF_T$). If dT or $\Delta T$ are low, a smoldering fire or a non exothermic flaming fire or nuisance exist. In that case, the function $F_T$ has no influence on the alarm threshold ($F_T$=1).

The function $F_{TR}$ is based on a combination of the temperature criterion $\Delta T$ and the ratio R, and defined to increase the reference function $F_R$ under certain conditions of the correlated criteria R and $\Delta T$. The purpose of this function $F_{TR}$ is to reduce the sensitivity of the detector 1 to exhaust fume characterized by the following conditions: If the ratio R is very high and $\Delta T$ is low, the nuisance is exhaust pipe fume. In that case, the decision is to increase the function $F_R$ by a maximum factor of $MaxF_{TR}$ to reduce the sensitivity to exhaust pipe fume ($F_{TR}$=$MaxF_{TR}$). If the ratio R is low or high or $\Delta T$ is high, the signature corresponds either to a flaming or smoldering fire or a nuisance except exhaust fume. In that case, the function $F_{TR}$ has no influence on the alarm threshold ($F_{TR}$=1).

The function $F_{Hr}$ is based on the humidity criteria Hr, dHr and $\Delta Hr$ and defined to increase the reference function $F_R$ depending on these humidity criteria. If Hr, dHr or $\Delta Hr$ are high, water-related nuisances or a condition with a high variation of humidity exist. In that case, the decision is to increase the function $F_R$ by a maximum factor of $MaxF_{Hr}$ to reduce the sensitivity to water-related nuisances. ($F_{HR}$=$MaxF_{Hr}$) Note that the function $F_{HR}$ is defined to contribute to the increase of the alarm threshold level mainly during a significant humidity criteria variation in order not to affect significantly the sensitivity of the detector 1 in a high humidity condition. This is reflected by the mathematical equation of the function $F_{Hr}$ presented below. Low values for Hr, dHr or $\Delta Hr$ suggest the presence of a fire or a nuisance, except water-related nuisances. In that case, the function $F_{Hr}$ has no influence on the alarm threshold ($F_{HR}$=1).

The function $F_\sigma$ is indicative of a dynamic scattering signal and defined to increase the reference function $F_R$ when a predetermined value of $\sigma$ is reached depending on the temperature criteria dT and $\Delta T$, humidity criteria Hr, $\Delta Hr$, and the backward signal B. Indeed, the function $F_\sigma$ is the main function of the algorithm as it combines the main relevant criteria in such a way that it allows to determine the type of nuisance with a certain level of confidence and to adjust the threshold accordingly. The nuisances to be discriminated by the function $F_\sigma$ are dust and water-related deceptive phenomena. Nevertheless, the function $F_\sigma$ is able to distinguish between real fire, dust and water-related nuisance, which is not possible by considering the dynamic scattering signal criterion alone.

Flaming fire from turbulences of the flame is generally characterized by a medium level of the dynamic scattering signal criterion. Therefore, the first criteria to be combined with the dynamic criteria are the temperature variation criteria ($\Delta T$ and dT) in order to suppress the effect of the function $F_\sigma$ in presence of the rise of the temperature. This can be summarised by the following condition: if dT or $\Delta T$ is high then $F_\sigma=1$. This behaviour is reflected in the mathematical equation for the function $F_\sigma$ by the function $g_\beta^\gamma(\alpha_2,\alpha_{\Delta T},\alpha_{dT})$ described below.

Smoldering fires are characterized by a low level of fluctuation of the scattering signal (low dynamic of the signal). Therefore, the combination of the dynamic scattering signal criterion and of the temperature criteria ($\Delta T$ and dT) allows to distinguish between a smoldering fire and a nuisance, such as dust or water-related nuisances: Therefore, when $\Delta T$ and dT are low the function $F_\sigma$ can increase to a maximum value of $MaxF_\sigma$ depending on the value of the dynamic criterion $\sigma$. This condition is summarized in the definition of the function $g_\beta^\gamma(\alpha_2,\alpha_{\Delta T},\alpha_{dT})$ as defined in the equation of $F_\sigma$.

The additional humidity criteria combined with the dynamic criterion and temperature criteria allows identifying the presence of a water-related nuisance with a very high level of confidence. Consequently, the level of the alarm threshold increases significantly so that false alarm warnings arising from water-related nuisances (like fog, haze, water steam . . . ) are suppressed.

Moreover, as the discrimination between smoldering fire and dust relies on the level of the dynamic scattering signal criteria only, the function $F_\sigma$ is set so that to discriminate the dust up to a certain level. In that case, the false alarm warnings due to dust particles are not suppressed but considerably reduced. The condition can be summarized as:

If $\Delta T$ and dT are low, Hr is low and $\sigma$ is high, then $F_\sigma=MaxF_\sigma$ if $B \leqq B1$ and $F_\sigma=1$, whereas if $\Delta T$ and dT are low, Hr is high and $\sigma$ is high (characteristics of a water-related nuisance) then $F_\sigma=MaxF_\sigma$. These conditions are summarized in the mathematical equation of the function $h(B, \alpha_{Hr})$ as defined in the function $F_\sigma$.

In one embodiment, the mathematical equation of the alarm threshold $Th_{adaptive}$ is expressed as:

$$Th_{adaptive} = F_R \times \left[\frac{F_{Hr} \times F_{TR} \times F_\sigma}{F_T}\right]$$

In one embodiment, the discrimination capabilities of the algorithm may be focussed on a few typical types of deceptive phenomena, for example, water related nuisances such as condensation, fog and water steam, dust particles suspended in air, and aerosol from exhaust pipe fumes.

The functions $F_R$ and $F_T$ characterize the type of fire in order to increase the sensitivity of the detector to flaming fire. The purposes of the other functions $F_{Hr}$, $F_{TR}$ and $F_\sigma$ are to identify the nuisance phenomena and to decrease the sensitivity according to the type of deceptive phenomena, the magnitude of the response of the scattering signals being dependent of the type of nuisance. Thus, the function $F_{Hr}$ provides information about the humidity condition of the environment, but could not by itself give a signature of fog, for example. Therefore, the function $F_{Hr}$ is set to contribute to the increase of the alarm threshold level mainly during a significant variation of the humidity criterion. Consequently, the sensitivity of the detector 1 will not be significantly affected in high humidity condition. However, the more complex functions $F_{TR}$ and $F_\sigma$, which combine several criteria, provide a high level of discrimination allowing to identify the type of nuisance and to adjust the alarm threshold level accordingly, as described above.

More particularly, these functions are defined as follows, wherein a function S, which is used in several of these functions, is defined as:

$$S_a^b(x) = \begin{cases} 0 & \text{if } x \le a \\ 2\cdot\left(\frac{x-a}{b-a}\right)^2 & \text{if } a < x \le \frac{a+b}{2} \\ 1-2\cdot\left(\frac{b-x}{b-a}\right)^2 & \text{if } \frac{a+b}{2} < x < b \\ 1 & \text{if } b \le x \end{cases}$$

with a and b constants, e.g., a=1 and b=2, and b>a.

In the following, the parameters may be selected for different levels of sensitivity and discrimination according to the application.

As mentioned above, the function $F_R$ is based on the ratio of the scattering signals and defined as:

$$F_R(n)=Th_1-(Th_1-Th_2)\cdot S_{r1}{}^{r2}(r(n)),$$

wherein $Th_1$ and $Th_2$ represent the nominal operating mode of the detector 1 without "temperature" and "humidity" channels, $Th_1$ is the threshold for smoldering fires and nuisances, $Th_2$ is the threshold for flaming fires, and $S(r_1, r_2)$ is the S function.

The function $F_T$ is defined as:

$$f_T(\alpha_{\alpha T},\alpha_{dT})=\max(1,\alpha_{\Delta T})^{K_{\Delta T}}\cdot(1+(2\cdot(Smf_{MidValueT}-1))\cdot S_1^{2\cdot K_{dT}-1}(\alpha_{dT})),$$

with:

$$\alpha_{\Delta T} = \frac{1}{Th_{\Delta T}}\cdot\Delta T = \frac{1}{Th_{\Delta T}}(T-T_0)$$

note that $\Delta T=T-T_0$, $$\alpha_{dT} = \frac{1}{Th_{dT}}\cdot dT_0$$

$\alpha_{\Delta T}$ is risen to the power of $K_{\Delta T}$, and multiplied by a factor that is in one embodiment between 1 and $1+(2\cdot(Smf_{MidValueT}-1))$ The function $F_{Hr}$ is defined as:

$$f_{Hr}(\alpha_{Hr},\alpha_{dHr})=\max(1,\alpha_{Hr})^{KHr}\cdot(1+(2\cdot(Smf_{MidValueHr}-1))\cdot S_1^{2\cdot K_{dHr}-1}(\alpha_{dHr}))$$

Where:

$$\alpha_{Hr} = \frac{1}{\max\left(\begin{matrix}1, Th_{Hr} - \\ (\Delta_{Hr} * 2)\end{matrix}\right)} \cdot Hr = \frac{1}{\max\left(\begin{matrix}1, Th_{Hr} - \\ ((Hr - Hr_0) * 2)\end{matrix}\right)} \cdot Hr,$$

note that $\Delta_{Hr}$=Hr−$Hr_0$, $$\alpha_{dHr} = \frac{1}{Th_{dHr}} \cdot dHr_0$$

$\alpha_{Hr}$ is risen to the power of $K_{Hr}$, and multiplied by a factor having a value between 1 and $1+(2\cdot(Smf_{MidValue_{Hr}}-1))$ The function $F_\sigma$ is defined as:

$$f_\sigma(\sigma, dT, \Delta T, B, \alpha_{Hr}) = \alpha_1 - [\alpha_1 - \max\{\alpha_1, h(\text{Backward}, \alpha_{Hr}) * g_\beta^\gamma(\alpha_2, \alpha_{\Delta T}, \alpha_{dT})\}] \cdot S_{\sigma 1}^{\sigma 2}(\sigma(n))$$

with h(B, $\alpha_{Hr}$), and $$h(B, \alpha_{Hr}) = [1 - S_{b1}^{b2}(B)] + [S_{\alpha 1}^{\alpha 2}(\alpha_{Hr})] - \{[1 - S_{b1}^{b2}(B)] * [S_{\alpha 1}^{\alpha 2}(\alpha_{Hr})]\}.$$

The function h(B, $\alpha_{Hr}$) is used for limiting the threshold variation in certain conditions of humidity so that the discrimination to dust is limited to a certain value, whereas the discrimination to water-related phenomena is higher thanks to the combination of the dynamic criterion and humidity criterion allowing to potentially rise the threshold to higher value.

A function g is used to inhibit the variance contribution on the adaptive threshold in presence of a flaming fire and defined as:

$$g_\beta^\gamma(\alpha, \alpha_{\Delta T}, \alpha_{dT}) = \max\left(\alpha_1, \frac{a_2}{\max(1, \{\beta \cdot (\alpha_{\Delta T} + \alpha_{dT} - [\alpha_{\Delta T} * \alpha_{dT}])\}^\gamma)}\right)$$

β and γ allow controlling the reduction of the variance effect in case of a significant value of ΔT or dT.

The function $F_{TR}$ is indicative of the coupling of the thermal and r=B/F criteria. Exhaust fumes are characterized by a relatively high value of the ratio B/F (B/F≈3) and a very low temperature rise. In order to decrease the sensibility of the detector 1 to this type of deceptive phenomenon, the following combination criteria of r=B/F and the temperature ($f_{TR}$) are implemented:

$$\begin{cases} \Delta T = (Temp - T0) \\ f_{TR}(\Delta T, r) = \max(1, [1 - (1 - 1/\xi) \cdot S_{TRmin}^{TRmax}(\Delta T)] \cdot [1 - (1 - \xi) \cdot S_{RTmin}^{RTmax}(r)]) \end{cases}$$

The processing unit of the detector 1 implements further a temperature detection algorithm that allows detection of exothermic flaming fires even if they do not generate visible smoke, such as an alcohol fire. A thermal threshold $Th_T$ is defined to vary depending on the temperature criterion variation ΔT so that the detection sensitivity increases when the temperature criterion ΔT rises significantly. The conditions required to trigger an alarm are that the temperature criterion T reaches the thermal alarm threshold $Th_T$ and that simultaneously the derivative temperature criterion dT exceeds a set value. This condition is implemented to limit the thermal alarm detection due to a significant environmental temperature variation as might be encountered in an aircraft cargo compartment.

In order to limit the activation of an alarm due to alarm threshold fluctuations, a confirmation logic AC for the adaptive threshold algorithm and a confirmation logic TC for thermal threshold algorithm are implemented. This confirmation step is set so as to limit an induced delay. The outputs of the logics AC, TC are input to an OR gate 86 and the final alarm output is triggered when either the temperature alarm or the adaptive alarm is activated, as shown in FIG. 5.

The invention claimed is:

1. An apparatus for detecting a hazardous condition including flaming or smoldering fire, smoke or both, comprising:

an optical module for measuring scattered light caused by the hazardous condition, wherein the optical module is configured to output at least one signal indicative of the scattered light;

at least one temperature sensor configured to output at least one signal indicative of a temperature in proximity of the temperature sensor;

a humidity sensor configured to output at least one signal indicative of humidity in proximity of the humidity sensor; and a processing unit coupled to receive the signals from the optical module, the at least one temperature sensor and the humidity sensor, wherein the processing unit is configured to process the signals to determine a plurality of criteria and to use these criteria to distinguish one or more deceptive phenomena from a hazardous condition in order to limit false alarm warnings and to enhance a detection performance by means of a main function based on at least one of the temperature criteria, humidity criteria and a backward scattering criterion, wherein the processing unit is further configured to use the criteria for adjusting an alarm threshold value for triggering an alarm indicative of said hazardous condition, wherein the alarm threshold value is a function of:

a reference function defined to modify the alarm threshold value between two values and according to a value of a ratio of both backward and forward scattering signals measured at the optical module, a temperature function based on temperature criteria from the temperature sensor defined to decrease the reference function if a rapid variation of ambient temperature exists, a temperature/ratio function based on at least one of the temperature criteria and the ratio in order to increase the reference function by a maximum factor to reduce a sensitivity of the apparatus if the ratio is very high and said temperature criterion is low, a humidity function based on humidity criteria to increase the reference function by a maximum factor to reduce the sensitivity of the apparatus if a high variation of humidity exists, and a variance function defined to increase the reference function when a predetermined value of a variance of the measurements of the backward scattering signal is reached depending on the temperature criteria, humidity criteria and the backward scattering signal.

2. The apparatus of claim 1, wherein the alarm threshold is expressed as:

$$Th_{adaptive} = F_R \times \left[\frac{F_{Hr} \times F_{TR} \times F_\sigma}{F_T}\right],$$

wherein $Th_{adaptive}$ is the alarm threshold value, $F_R$ is the reference function, $F_{Hr}$ is the humidity function, $F_{TR}$ is the temperature/ration function, $F_o$ is the variance function, and $F_T$ is the temperature function.

3. The apparatus of claim 1, wherein the processing unit is configured to adjust the thermal threshold value to vary a detection sensitivity depending on a temperature criterion indicative of a variation of the temperature.

4. The apparatus of claim 3, wherein the processing unit is configured to delay a first signal indicative of an exceeded thermal threshold value by a first predetermined delay time, and to delay a second signal indicative of an exceeded alarm threshold value by a second predetermined delay time.

5. The apparatus of claim 3, wherein the processing unit is configured to trigger an alarm if either the thermal threshold value or the alarm threshold value is exceeded.

6. The apparatus of claim 1, wherein the processing unit is configured to sample the signals from the optical module, the at least one temperature sensor and the humidity sensor with a predetermined sampling time.

7. The apparatus of claim 6, wherein the sampling time is about 200 ms.

8. The apparatus of claim 1, wherein the optical module is configured to output a backward scattering signal, and wherein the processing unit is configured to limit signal peaks of the backward scattering signal to obtain a backward scattering criterion.

9. The apparatus of claim 1, wherein the processing unit uses the plurality of criteria to determine a plurality of functions.

* * * * *